US006388637B1

(12) United States Patent
Davis

(10) Patent No.: US 6,388,637 B1
(45) Date of Patent: May 14, 2002

(54) WIDE BAND, WIDE SCAN ANTENNA FOR SPACE BORNE APPLICATIONS

(75) Inventor: Daniel Davis, Baltimore, MD (US)

(73) Assignee: Northrop Grumman Corporation, Los Angeles, CA (US)

( * ) Notice: Subject to any disclaimer, the term of this patent is extended or adjusted under 35 U.S.C. 154(b) by 0 days.

(21) Appl. No.: 09/596,491

(22) Filed: Jun. 19, 2000

Related U.S. Application Data

(60) Provisional application No. 60/177,282, filed on Jan. 21, 2000.

(51) Int. Cl.[7] ..... H01Q 15/20

(52) U.S. Cl. ..... 343/915; 343/781 P; 343/781 R; 343/840; 343/DIG. 2

(58) Field of Search ..... 343/915, DIG. 2, 343/781 P, 840, 893, 781 R; 455/422

(56) References Cited

U.S. PATENT DOCUMENTS 6,041,232 A * 3/2000 Jennings, III ..... 455/422

6,268,835 B1 * 7/2001 Toland et al. ..... 343/781 P

* cited by examiner

*Primary Examiner*—Don Wong
*Assistant Examiner*—Hoang Nguyen

(57) ABSTRACT

A plurality of paraboloidal reflector cells are mounted side by side in a concave spherical array in the interior of a toroidal support structure. Groups of adjoining reflector cells are selected for activation to point the antenna in a given direction. The activated elements of the group operate to roughly steer a beam in the desired direction, by switching feeds. Inter-element time delay steering is then used to precisely steer the beam to the desired direction. The groups of reflector cells are selected to provide a required number of pointing angles within a small cone, determined by the center of the group. Each reflector cell, moreover, includes a planar array of feed elements located at or forward of the focal point of its respective reflector element. A predetermined number of feed elements in each feed array of a beam group are selected for operation at any one time and comprises feed elements pointing closest to the desired beam position. A composite beam is then formed from all of the feed elements in the beam group.

25 Claims, 4 Drawing Sheets

WIDE BAND, WIDE SCAN ANTENNA FOR SPACE BORNE APPLICATIONS

CROSS REFERENCE TO RELATED APPLICATION

This invention is related to the invention shown and described in related application U.S. Ser. No. 09/596,492, (Northrop Grumman Docket No. BD-99-091) entitled "Limited Field Of View Antenna For Space Borne Applications", filed in the name of Daniel Davis, the present inventor, on Jun. 19, 2000, and assigned to the assignee of this invention, and which is meant to be incorporated herein by reference in its entirety.

This application claim benefit to provisional application 60/177,282 Jan. 2, 2000.

BACKGROUND OF THE INVENTION

This invention relates generally to antennas used for space applications and, more particularly, to an oversized wide band, wide scan antenna which is stowed in a collapsed state and thereafter deployed when in orbit.

Extremely large scanning antennas for space applications and having limited scan requirements are well known. As the antenna is moved away from the Earth, the scan angles are reduced; however, the size of the antenna increases making the deployment and steering of very large antennas a formidable task. Such large scanning antennas typically use parabolic reflectors with clusters of feed elements at or near the focal point to scan the beam.

SUMMARY

Accordingly, it is an object of the present invention to provide an improvement in wide band, wide scan antennas.

It is a further object of the invention to provide an improvement in wide band, wide scan antenna for space applications.

It is a further object of the invention to provide a light weight oversized wide-band, wide scan antenna for space applications which uses multiple reflectors as elements of a large aperture for a radar system deployed in space.

One aspect of the invention is directed to a deployable space borne antenna, comprising: a reflector support structure; a plurality of reflector cells mounted side by side in a concave spherical array in an interior portion of the support structure so as to form a radar aperture; each reflector cell includes a parabolic RF signal reflector and an RF feed assembly; each reflector having a flexible reflecting surface and a plurality of elongated edges defining a geometric shape, and including respective corner portions at the intersection of pairs of edges; respective rigid support members located at the corner portions of the reflector for stiffening the reflector and the elongated edges, and also for providing a support for the array of feed elements; a set of flexible support members extending between the rigid support members of each reflector cell and the respective array of feed elements for positioning the array above the RF signal reflector, and a mechanism located beneath each of the RF signal reflectors for pulling the respective flexible reflecting surface down to a substantially parabolic shape.

Another aspect of the invention is directed to a radar antenna system, comprising: a plurality of reflector cells mounted side by side in a concave spherical array; each reflector cell including a parabolic RF signal reflector and an RF feed assembly; wherein said RF feed assembly includes a plurality of feed elements arranged in a plane; and wherein said plurality of reflector cells operate in multiple groups of reflector cells and wherein each reflector cell generates a respective beam of radiation which combines to form a composite beam of radiation pointed in a predetermined direction.

Still another aspect of the invention is directed to a method of scanning a beam of radiation by a plurality of mutually adjacent parabolic reflector cells which are arranged in a concave array and which point to the center of a sphere, each respective cell having a feed assembly comprised of a set of feed elements arranged in a planar feed array, comprising the steps of: operating the plurality of reflector cells in a beam group of reflector cells selected for a predetermined pointing angle within a cone fixed by a center of the selected beam group; and, selecting and energizing a predetermined relatively small number of feed elements in comparison to the total number in said set of feed elements in the feed assembly of each reflector cell of said beam group which most closely points to a desired beam position.

Applicability of the present invention will become apparent from the detailed description provided hereinafter. It should be noted, however, that the detailed description and specific example, while indicating the preferred embodiment of the invention is provided by way of illustration only, since alternations and modifications coming within the spirit and scope of the invention will become apparent of those skilled in the art from this detailed description.

BRIEF DESCRIPTION OF THE DRAWINGS

The present invention will become more fully understood from the detailed description which follows and the accompanying drawings which are provided by way of illustration only and are thus not meant to be limitative of the present invention, and wherein.

DETAILED DESCRIPTION OF THE INVENTION

This invention is directed to a wide band, wide scan antenna comprised of a plurality of paraboloidal reflector cells mounted side by side in a concave spherical array in the interior of a toroidal support structure so as to point to the center of a sphere. Groups of adjoining reflector cells are selected for activation to point the antenna in a given direction. The activated elements of the group operate to roughly steer a beam in the desired direction, by switching feeds. Inter-element time delay steering is then used to precisely steer the beam to the desired direction. The groups of reflector cells are selected to provide a required number of pointing angles within a small cone, determined by the center of the group. The cone is relatively small in terms of the beam width of the reflector cell. Each reflector cell, moreover, includes a planar array of feed elements located at the focal point of a parabolic element. A predetermined small number of feed elements, in each feed array, is selected for operation at any one time and comprises the feed element pointing closest to the desired beam position. A composite beam is then formed from all of the feed elements in the beam group.

Each reflector cell, moreover, includes a reflector element having a flexible fabric type reflecting surface including a plurality of elongated edges defining a geometric shape and including respective corner portions at the intersection of pairs of edges. A set of rigid support members are located at the corner portions of the reflector for stiffening the reflector as well as the elongated edges and also for providing a support for the array of feed elements. A system of flexible support members extending between the rigid support members of each reflector cell and the respective array of feed elements are used to position the feed array above the reflector element. A set of backup wires is located beneath each of the reflector elements for pulling the respective flexible reflecting surface down to a substantially parabolic shape. Such a structure allows the antenna to be stowed in a collapse state and then deployed when placed in orbit.

Figure 1:
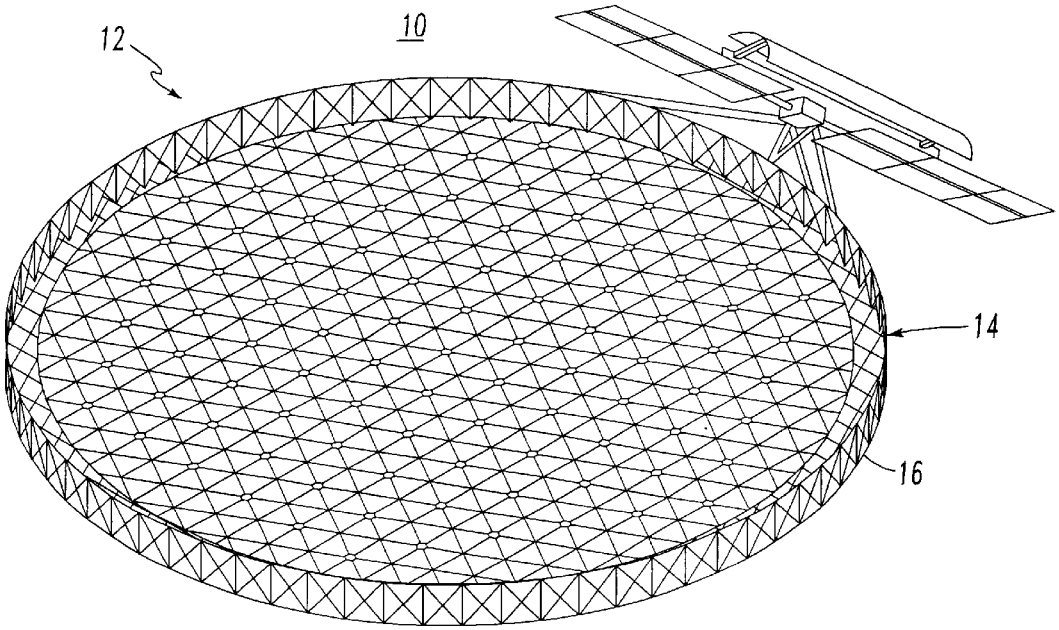
FIG. 1 is a perspective view generally illustrative of a space borne antenna system including an embodiment of the subject invention.
Figure 2:
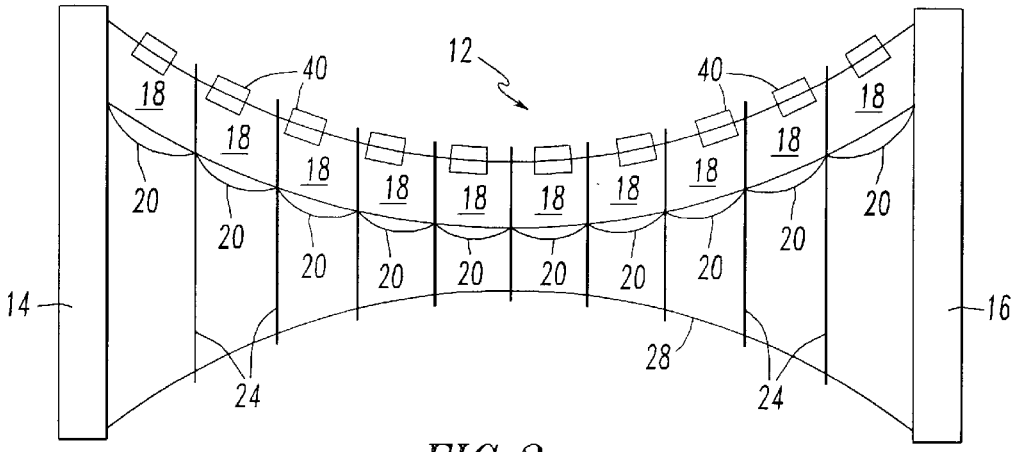
FIG. 2 is a mechanical diagram generally illustrative of the preferred embodiment of the invention included in antenna system shown in FIG. 1.

Referring now to the drawing figures, wherein like reference numerals refer to like parts throughout, FIG. 1 depicts a space borne antenna system 10 including an L-band sub-system 12 which includes an embodiment of the subject invention shown in FIG. 2. The sub-system 12 comprises a relatively large inflatable antenna assembly 14 which includes a torus support structure 14 and which is, for example, 52.6 meters in diameter and supports a 2000 $m^2$ aperture for a space-borne radar system. The antenna assembly 14 includes a spherical surface 16 as shown in FIG. 2 and formed by an array of adjoining parabolic RF signal reflector cells 18. The details of one of the reflector cells are shown in FIG. 3.

Figure 3:
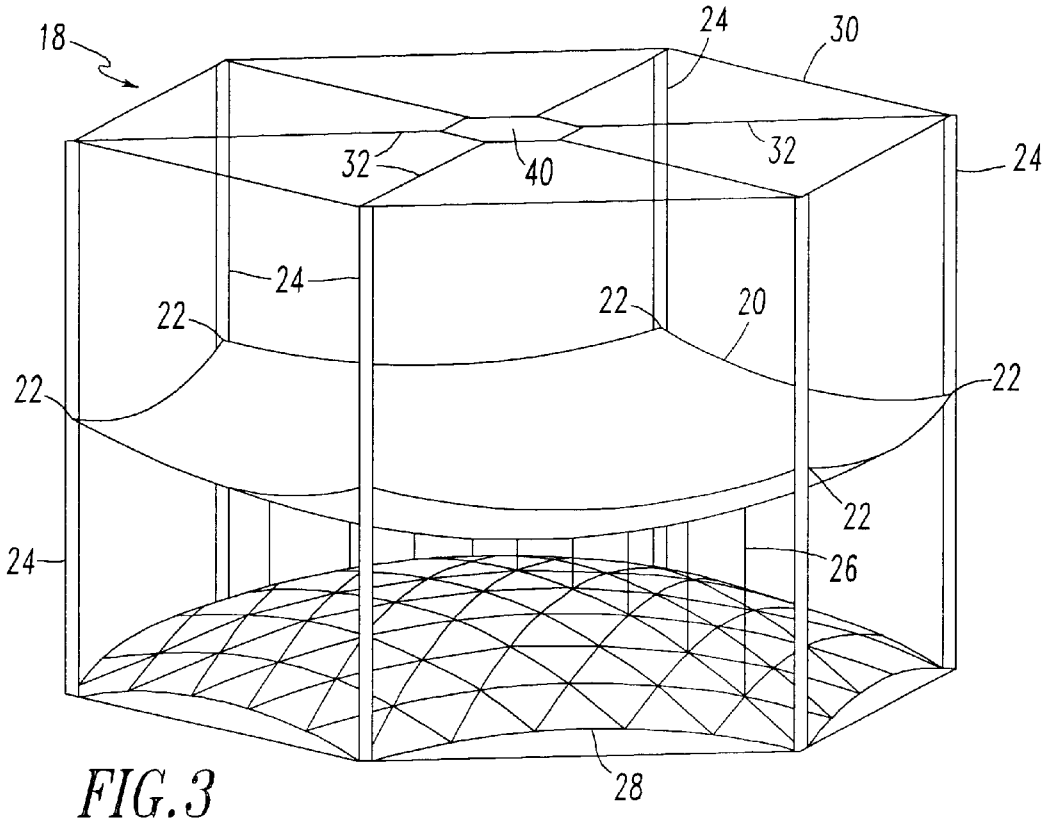
FIG. 3 is a perspective view illustrative of the details of a single reflector cell of the antenna structure shown in FIG. 2.

As shown in FIG. 3, each reflector cell 18 includes a mesh-type flexible fabric reflector element 20 which is supported at six corners 22 by a set of elongated rigid support members 24 comprised of graphite tubes so that the paraboloidal reflector element 20 forms a hexagon in top plan view as shown. A system of backup wires 26 and 28 provide a mechanism for pulling the reflector element 20 down to a substantially parabolic shape which faces outward. The outer ends of the elongated support members 24 attach to a set of support wires 30 and 32 which operate to position a multiple element feed array 40 above the reflector surface 20 substantially at the focal point; however, when desirable, the feed array 40 can be moved forward of the focal point.

Figure 4:
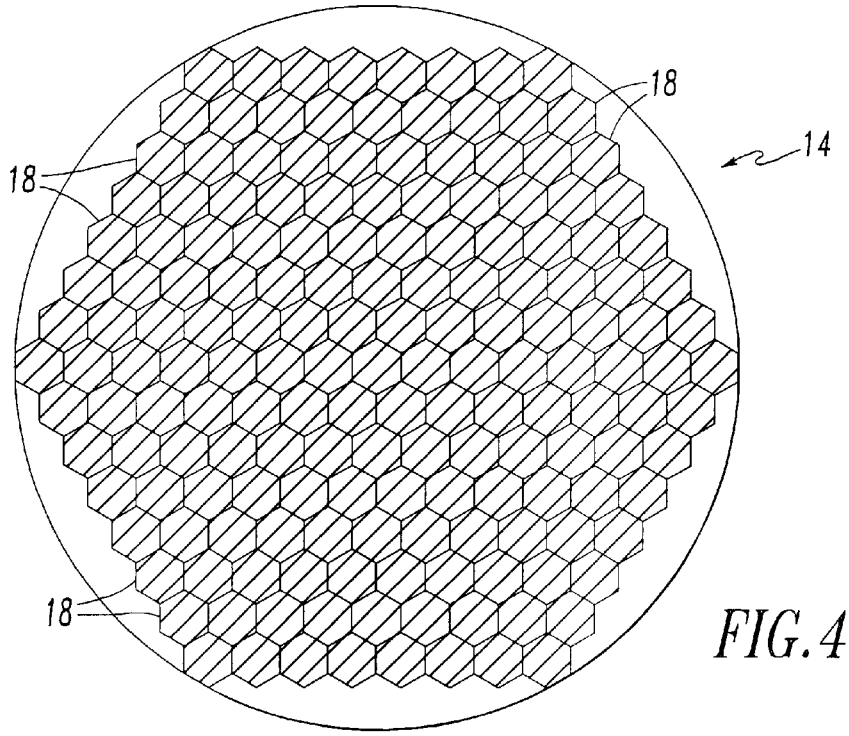
FIG. 4 is a top planar view of the antenna system shown in FIG. 2.
Figure 5:
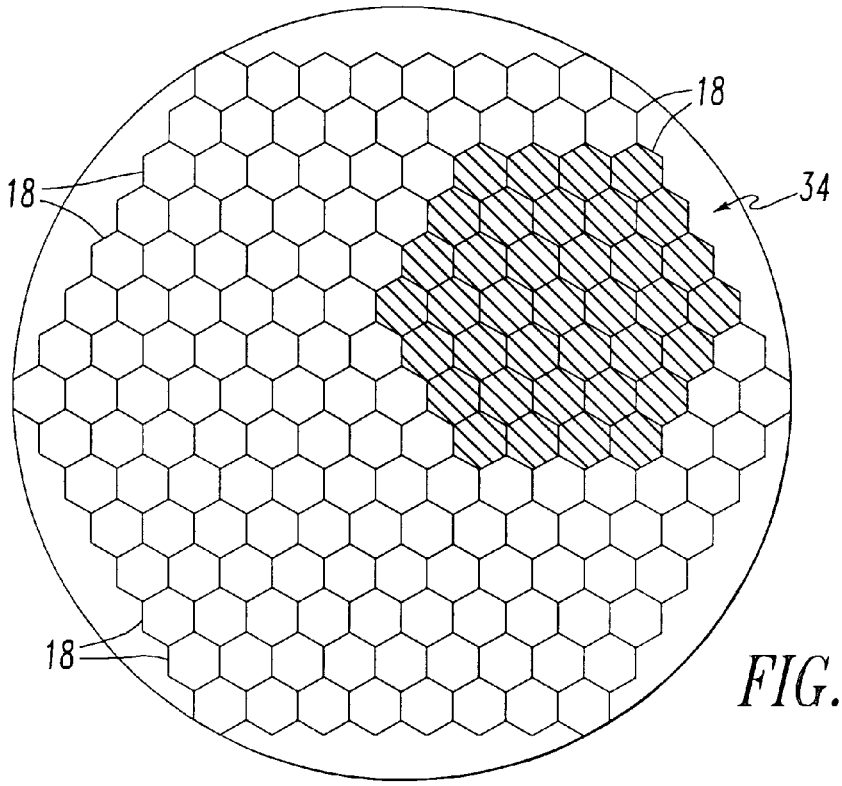
FIG. 5 is a top planar view of the antenna system shown in FIG. 4 and being illustrative of a selected group of reflector cells used for directing a beam of radiation.

While the full aperture of the antenna (FIG. 2) is shown in FIG. 4, only a portion of the aperture is used at any given time to generate and steer a beam in a desired direction. This is shown, for example, in FIG. 5 where a group 34 of contiguous reflector cells 18 are selected for use. Each cell 18 generates a respective beam of radiation which is coherently combined to form a composite beam of radiation pointed in a predetermined direction.

Figure 6:
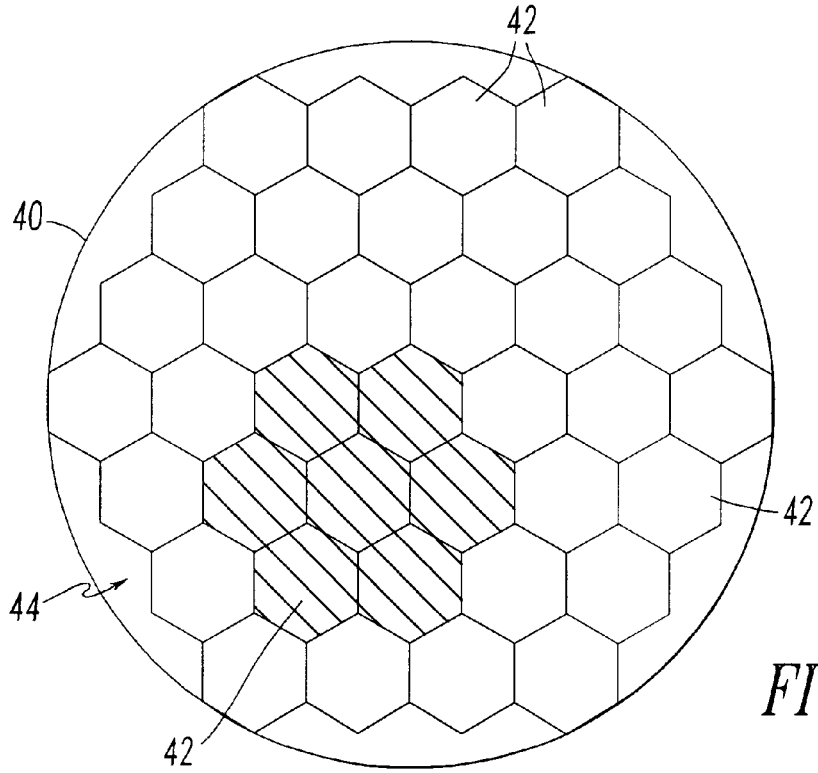
FIG. 6 is a front planar view generally illustrative of a feed array for each of the reflector cells shown in FIG. 5 and wherein a small group of feed elements is selected for activation.
Figure 7:
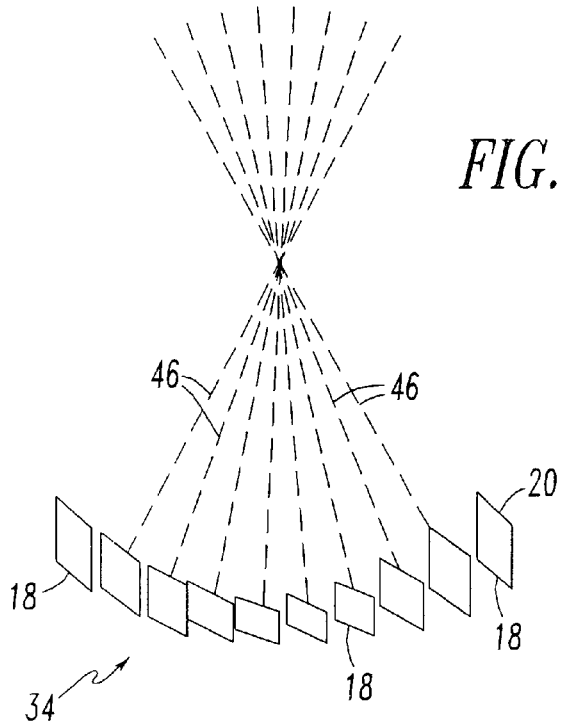
FIG. 7 is a diagram illustrative of a beam of radiation generated by a group of reflector cells shown, for example, in FIG. 5; and, FIG. 8 is a diagram illustrative of each paraboloidal reflector cell being roughly steered to a central beam.

Each paraboloidal reflector cell 18, as shown in FIG. 3, moreover, includes a feed assembly 40 which comprises a planar array of feed elements 42 as shown in FIG. 6, and where a relatively small predetermined number of feed elements 42, for example, a set 44 of three or more feed elements, of the feed array 40 is selected and energized to generate and coarsely steer a respective beam to a desired beam position within a small cone set by the center of the group as shown in FIG. 7. The feed elements 42 pointing closest to the desired beam position is selected as the feed element set 44. Time delay steering is then used to provide fine steering in a well known manner.

It may be necessary in certain applications to move the planar feed array 40 forward of the focal point of the reflector thereby feeding at a plane closer to the reflector 20 (FIG. 3) and utilizing a relatively greater number of feed elements in the feed set 44 than heretofore so as to spread the feed over many elements; however, the number of elements would still be less than the total number of elements in the feed array 40 in order to provide offset feeding.

Figure 8:
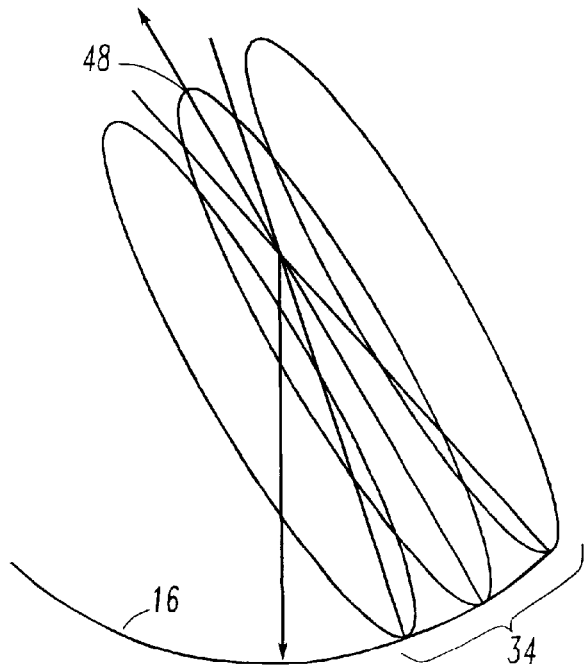

Referring now to FIG. 7, reference numeral 46 denotes the individual beams generated by the selected elements 44 of reflector cells 18 in group 34 (FIG. 5) while reference numeral 48 in FIG. 8 denotes a composite beam resulting from a combining of the individual beams 46.

Thus, by offset feeding of each reflector cell 18, each reflector in a radiating subgroup is nominally pointed in a desired direction due to the spherical shape of the overall antenna. By selecting the optimum offset feed, from a multi-element feed assembly in the focal plane of each reflector, the individual reflector beam is coarsely steered, with inter-element time delays then providing precise steering of the group.

Typically, using an offset feed paraboloidal such as shown in FIGS. 2–6, acceptable beams can be formed up to 15 to 20 beam widths from the center axis of the aperture. In the configuration shown in FIG. 2, offsets of less than 10 beam widths are required.

From the above, it will be appreciated that the present invention permits the deployment of a Wide Band, Wide Scan Antenna for Space Borne Applications by forming a plurality of reflector cells in a flexible reflective membrane using rigid support members that abut the flexible membrane at spaced locations and a mechanism, such as tension wires, that pulls the flexible membrane against the rigid support members to form the reflector cells.

Having thus shown and described what is at present considered to be the preferred embodiment of the invention it should be noted that the same has been made by way of illustration and not limitation. Accordingly, all modifications, alterations, and changes coming within the spirit and scope of the invention, as set forth in the appended claims, are herein meant to be included.

What is claimed is:

1. A deployable space borne antenna, comprising:

a reflector support structure;

a plurality of reflector cells mounted side by side in a concave spherical array in an interior portion of the support structure so as to form a radar aperture;

each reflector cell includes a parabolic RF signal reflector and an RF feed assembly;

each reflector having a flexible reflecting surface and a plurality of elongated edges defining a geometric shape, and including respective corner portions at the intersection of pairs of edges;

respective rigid support members located at the corner portions of the reflector for stiffening the reflector and the elongated edges, and also for providing a support for the array of feed elements;

a set of flexible support members extending between the rigid support members of each reflector cell and the respective array of feed elements for positioning the array above the RF signal reflector, and a mechanism located beneath each of the RF signal reflectors for pulling the respective flexible reflecting surface down to a substantially parabolic shape.

2. An antenna according to claim 1 wherein the reflector support structure comprises a toroidal support structure.

3. An antenna according to claim 1 wherein each said feed assembly includes a plurality of feed elements.

4. An antenna according to claim 3 wherein said plurality of feed elements are arranged in a planar array including a plane passing through or forward of a focal point of the parabolic reflector.

5. An antenna according to claim 4 wherein said plurality of reflector cells operate in groups of reflector cells and wherein each reflector cell generates a respective beam of radiation which combines to form a composite beam of radiation pointed in a predetermined direction.

6. An antenna according to claim 5 wherein a predetermined number of said feed elements of each said planar array are used to generate the respective beam.

7. An antenna according to claim 6 wherein said predetermined number of elements comprises a relatively small number of feed elements in relation to the total number of feed elements in the feed array.

8. An antenna according to claim 3 wherein each of said group of reflector cells comprise a set of mutually adjacent reflector cells.

9. An antenna according to claim 8 wherein at least one group of mutually adjacent reflector cells comprises about 10% of said plurality of parabolic reflector cells.

10. A radar antenna system, comprising a plurality of reflector cells mounted side by side in a concave spherical array;

each reflector cell including a parabolic RF signal reflector and an RF feed assembly, wherein said RF feed assembly includes a plurality of feed elements arranged in a plane; and wherein said plurality of reflector cells operate in multiple groups of reflector cells and wherein each reflector cell generates a respective beam of radiation which combines to form a composite beam of radiation pointed in a predetermined direction.

11. An antenna system according to claim 10 wherein a predetermined number of said feed elements of each RF feed assembly are used to generate the respective beam.

12. An antenna system according to claim 11 wherein said plane of feed elements passes through a focal point of the parabolic reflector, and wherein said predetermined number of feed elements comprises a relatively small number of elements in comparison to the total number of elements of the feed element array.

13. An antenna system according to claim 12 wherein said plane of feed elements is moved forward of said focal point and wherein said predetermined number of feed elements comprises a greater number of feed elements than said relatively small number of feed elements.

14. An antenna system according to claim 13 wherein each said group of reflector cells comprise a set of mutually adjacent reflector cells.

15. An antenna system according to claim 14 wherein at least one group of mutually adjacent reflector cells comprises about 10% of said plurality of parabolic reflector cells.

16. An antenna system according to claim 11 wherein said plurality of feed elements comprise an array of mutually adjacent feed elements.

17. A method of scanning a beam of radiation by a plurality of mutually adjacent parabolic reflector cells which are arranged in a concave array and which point to the center of a sphere, each respective cell having a feed assembly comprised of a set of feed elements arranged in a planar feed array, comprising the steps of:

operating the plurality of reflector cells in a beam group of reflector cells selected for a predetermined pointing angle within a cone fixed by a center of the selected beam group; and selecting and energizing a predetermined relatively small number of feed elements in comparison to the total number in said set of feed elements in the feed assembly of each reflector cell of said beam group which most closely points to a desired beam position.

18. A method according to claim 17 wherein the number of feed elements comprises a first predetermined number of feed elements when the first assembly is located at the focal point and a second predetermined number of feed elements when the feed assembly is located forward of the focal point.

19. A method according to claim 18 wherein said second predetermined number of feed elements is greater than said first predetermined number of feed elements.

20. A method according to claim 17 and additionally including the step of time delay steering to provide a fine scanning of the antenna beam to the desired beam position.

21. A method according to claim 17 wherein each said reflector cell includes a parabolic reflector element and said feed assembly thereof is located at or forward of a focal point of the respective parabolic reflector element.

22. A method according to claim 17 wherein said beam group of reflector cells includes about 10% of the array of reflector cells.

23. A method according to claim 17 and additionally including the step of deploying the array of reflector cells in space.

24. A method according to claim 17 and additionally including the step of mounting the array of reflector cells in a toroidal support structure for deployment in space.

25. A method according to claim 24 wherein each reflector element defines a geometrical shape including a plurality of elongated edges.

* * * * *